United States Patent [19]

Charlton

[11] Patent Number: 4,619,850

[45] Date of Patent: Oct. 28, 1986

[54] DECORATIVE WINDOW PRODUCT AND PROCESS

[75] Inventor: Thomas J. Charlton, Camano Island, Wash.

[73] Assignee: Alltech Corporation, Bellevue, Wash.

[21] Appl. No.: 690,954

[22] Filed: Jan. 11, 1985

[51] Int. Cl.[4] ..... B44F 1/06

[52] U.S. Cl. ..... 428/38; 52/311

[58] Field of Search ..... 428/38; 164/47, 138; 156/63, 242; 52/311, 314

[56] References Cited

U.S. PATENT DOCUMENTS

| | | | |
|---|---|---|---|
| 676,122 | 6/1901 | Byrnes | 428/38 |
| 3,460,303 | 8/1969 | Algrain et al. | 428/38 X |
| 4,127,689 | 11/1978 | Holt | 428/38 |
| 4,154,880 | 5/1979 | Drennan | 428/38 |
| 4,194,669 | 3/1980 | Bromberg | 428/38 X |
| 4,217,326 | 8/1980 | Goralnik | 428/38 X |
| 4,252,847 | 2/1981 | Del Grande | 428/38 |
| 4,302,260 | 11/1981 | Meltzer | 428/38 X |
| 4,312,688 | 1/1982 | Brodis et al. | 428/38 X |
| 4,335,170 | 6/1982 | Butler | 428/38 |
| 4,343,758 | 8/1982 | Goralnik | 428/38 X |
| 4,367,250 | 1/1983 | Quadling et al. | 428/38 |
| 4,438,165 | 3/1984 | Butler | 428/38 |
| 4,488,919 | 12/1984 | Butler | 428/38 X |
| 4,495,739 | 1/1985 | Drennan | 428/38 X |
| 4,518,446 | 5/1985 | Drennan | 428/38 X |

FOREIGN PATENT DOCUMENTS

| | | | |
|---|---|---|---|
| 1116470 | 1/1982 | Canada | 428/38 |

*Primary Examiner*—Henry F. Epstein

*Attorney, Agent, or Firm*—Robert E. Browne; Ralph R. Rath

[57] ABSTRACT

A decorative glass window product (10) including: (a) a sheet of glass (12); (b) a metal design component (14) in the form of a unitary, pre-cast, reticulated came network (16, 18), the design component (14) being bonded on its inner surface (22) to one side of the sheet of glass (12); and (c) a thin layer of an elastomeric adhesive (24) bonding the design component (14) to the sheet of glass (12). A process for making a decorative glass window product (10) including the steps of: (a) casting a unitary, reticulated metal came network (16, 18); (b) subjecting the reticulated came network (16, 18) to a finishing process wherein the color or finish of the came network is changed; and (c) elastomerically bonding the came network (16, 18) to one side of a continuous sheet of glass (12).

11 Claims, 7 Drawing Figures

DECORATIVE WINDOW PRODUCT AND PROCESS

BACKGROUND OF THE INVENTION (1) Field of the Invention

The invention relates to decorative glass windows and to processes of manufacturing them.

(2) Description of the Prior Art

Traditional leaded glass windows, wherein the individual pieces of glass are fitted together by hand and supported by H-shaped lead cames which are soldered together and which have grooves that hold the peripheral edges of the fitted pieces of glass have been known for at least seven hundred years. They are, however, inherently weak and costly to make because they are made by hand and they have the disadvantage that putty is required to seal the space between the glass and the lead came. Over a period of time, this type of seal deteriorates and will allow water to seep through the window. Thus, high cost and water leakage have been the main disadvantages of traditional hand-made leaded glass windows.

The relevant art of leaded glass windows and simulations thereof is well-developed. The following representative patents illustrate the state of the art prior to the present invention. Holt U.S. Pat. No. 4,127,689 teaches a simulated stained glass article and method for its production wherein a sheet 16 of transparent or translucent plastic material is provided with a layer 11 of thermosetting or thermofluid composition. The layer 11 is colored to provide the appearance of lead cames. If the layer 11 is made of a thermosetting composition it is preferably a polyester resin or an epoxy base with fillers. Alternatively, the layer 11 may be a thermofluid composition comprising a hard wax base and fillers appropriate to give adhesion to the sheet 16. The thermosetting or thermofluid composition may be applied to the sheet 16 to form the layer 11 by passing the composition through a metal screen which has a pattern of apertures therein corresponding to the desired shape of the layer 11.

Drennan U.S. Pat. No. 4,154,880 discloses a leaded glass pane wherein the flexible lead moulding 18 having a channel formed on the underside thereof as shown in FIG. 3 is secured to the face of the single pane of glass 14 by means of a polysulphide adhesive 26. The catalyzed polysulphide adhesive is plastic when applied but cures to a firm rubber-like consistency after about eight hours, providing a secure bond. The adhesive is first extruded from a nozzle into the channel formed on the underside of the concave lead moulding 18. The sides of the channel of the lead moulding 18 have inwardly directed flanges 28 which form a mechanical interlock with the adhesive 26 to prevent removal of the lead moulding 18 from the pane 14.

Goralnik U.S. Pat. No. 4,217,326 discloses a method of making a cut glass panel 1 comprising a plurality of glass pieces 3 (FIG. 5) arranged with cames 5 made of epoxy resin 8 in a predetermined pattern between adjacent edges 7 of the glass pieces 3 and having flanges 9 and 13 on both sides of the glass pieces. The method comprises the steps of: (a) providing a silicone rubber mold 19 (FIG. 3) having grooving 21 in the upper face 23 in the pattern of the cames 5; (b) introducing epoxy resin 8 material into the grooving 21; (c) allowing the epoxy resin 8 to set in the mold 19 to form the flanges 9 for one side of the glass pieces; (d) removing the flanges 9 from the mold 19; (e) positioning the glass pieces 3 on the mold 19; (f) introducing epoxy resin 8 in the spaces 17 between adjacent glass pieces 3 to fill the grooving 21 and the spaces 17; (g) positioning the previously formed flanges 9 on the upper surface of the glass pieces 3 so as to engage the epoxy resin 8 at the top of the spaces 17 (FIG. 4); (h) allowing the epoxy resin 8 to set to form the flanges 13 on the other side of the glass pieces 3 and the webs of the cames and to bond the flanges 9 to the cames 5; and, (i) removing the completed panel 1 from the mold 19.

Brodis et al U.S. Pat. No. 4,312,688 teaches a method and apparatus for making simulated stained glass using an existing installed glass surface 18. The outline of a design is traced or drawn on the glass surface to be decorated. Then flexible lead stripping 20, one face of which carries a pressure sensitive adhesive 20*a*, is applied to the surface 18 in registration with the outline thereby delineating the lead-stripped areas. The edges of the lead stripping 20 are boned, sealing these edges to the surface 18. Colored plastic thin-film stock 16 having adhesive coating 16*a* is cut so as to be complementary to the lead-delineated area and then applied thereto.

Butler U.S. Pat. No. 4,335,170 discloses a method of making simulated stained and leaded glass windows which includes bonding flexible extruded lead strips 20 to a pane of glass 10 using an adhesive 21 to form design segments and then bonding tinted Mylar coatings 30 to the pane 10 using an adhesive 31 to simulate colored glass. Butler U.S. Pat. No. 4,438,165 teaches a method which is similar to that disclosed in Butler U.S. Pat. No. 4,335,170.

Drennan Canadian Patent No. 1,116,470 teaches a bevelled glass leaded window consisting of a base pane 14, a flexible extruded sections of channeled came 30, soldered joints 32, a polysulphide adhesive 44 in the channeled came adhesively securing the came 30 to the window pane 14, and a bevelled glass overlay 18 adhesively secured by epoxy adhesive 22 to the windowpane 14. One edge of the came 30 overlies the marginal bevelled edges of the overlay 18.

For several years, Charlton Industries, Inc., of Redmond, Wash., has been commercially manufacturing a leaded glass window product which is sold under the trademark "DuraSeal". This product is similar to a traditional leaded glass window in that it has individual pieces of glass held by cames, but a "DuraSeal" window is different from a traditional leaded glass window in that the lead-alloy cames are cast simultaneously around the individual pieces of glass. In order to provide the necessary structural support for the window, a border is cast around the periphery of the entire window when the cames are cast.

SUMMARY OF THE INVENTION

The present invention is a decorative glass window product which has the appearance and beauty of a traditional leaded glass window, but without its disadvantages. The inventive window can be made by an efficient mechanized system of manufacturing and, thus, it can be mass-produced at a lower cost compared to a traditional leaded glass window. Units of the present window are consistent and are made exactly to a user's specifications because every piece is identical from unit to unit.

Unlike hand-made leaded glass, the present window is inherently strong and will never sag, rattle, or bend, and it has no putty to streak when washed or to turn white and flaky. The window of this invention is weatherproof because it has a continuous sheet of glass giving it an impregnable energy-efficient weatherproof seal. Safety is another feature of the invention because with a continuous sheet of tempered glass, breakage is virtually eliminated. Finally, the present window can be made in a variety of ornamental modes having clear or translucent glass or any color of the rainbow, with limitless design possibilities in selectively glue-chipped, etched, or colored patterns. In summary, the inventive window has all of these features: it is consistent, strong, clean, ornamental, weatherproof, and safe.

In one aspect, the invention is a decorative glass window product including: (a) a sheet of glass; (b) a metal design component in the form of a unitary, pre-cast, reticulated came network, the design component being bonded on its inner surface to one side of the sheet of glass; and (c) a thin layer of an elastomeric adhesive bonding the design component to the sheet of glass.

In another aspect, the invention is a process for making a decorative glass window product including the steps of: (a) casting a unitary, reticulated metal came network; (b) subjecting the reticulated came network to a finishing process when the color or finish of the design component is to be changed; and (c) elastomerically bonding the came network to one side of a continuous sheet of glass.

DESCRIPTION OF THE PREFERRED EMBODIMENTS

A. The Decorative Glass Window Product

Figure 1:
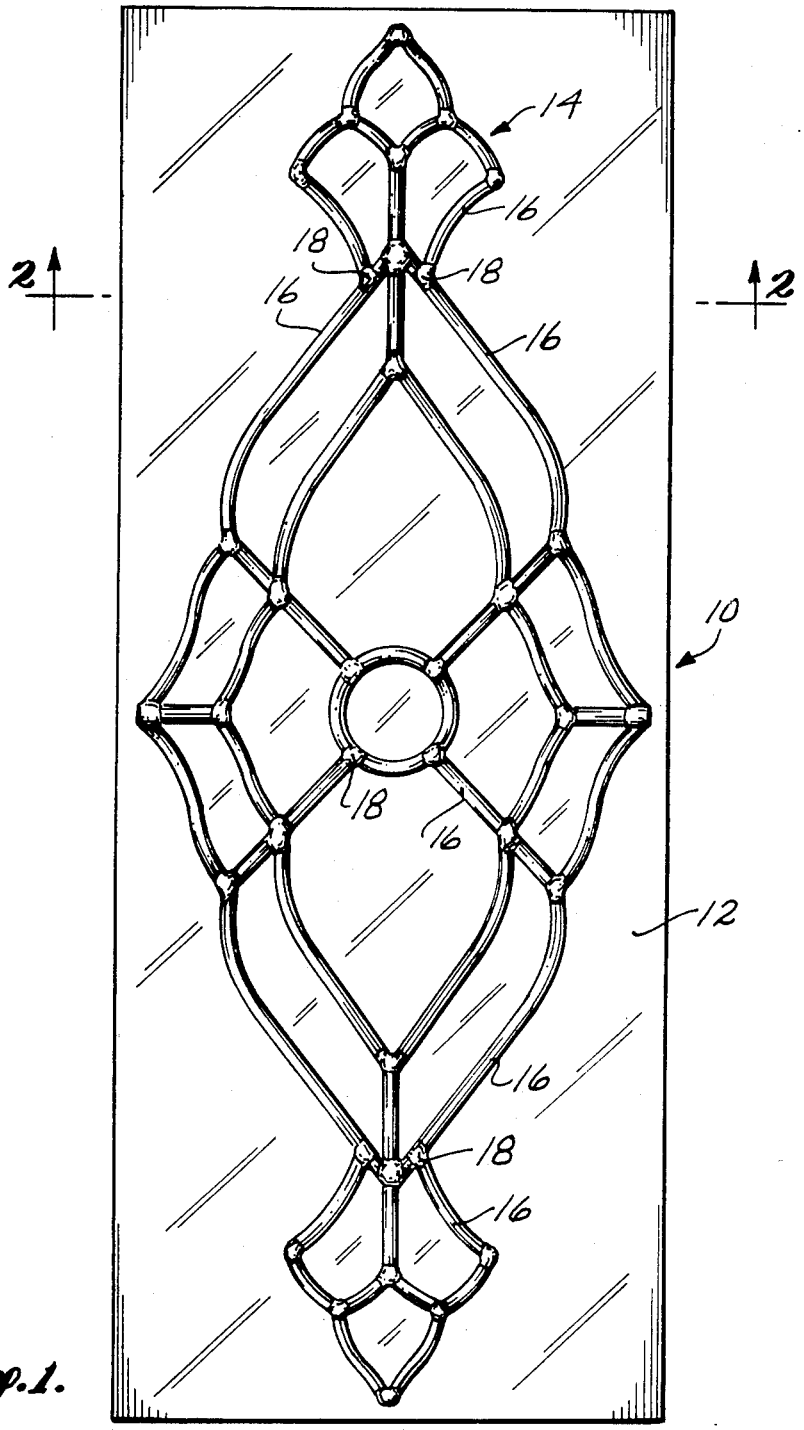
FIG. 1 is a side elevational view of a first embodiment of a basic glass window product of the present invention.
Figure 2:
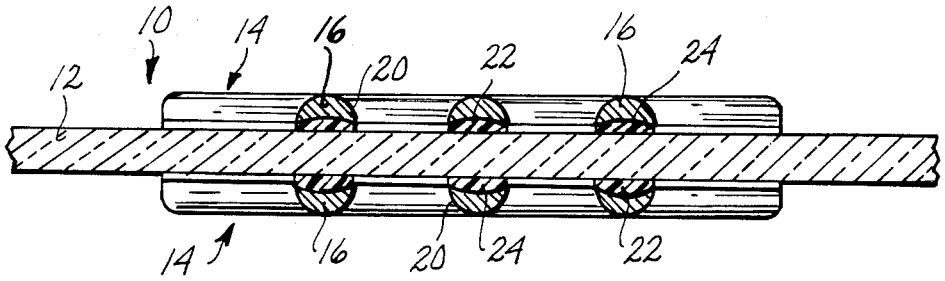
FIG. 2 is a cross-sectional view taken along the line 2—2 shown in FIG. 1.

Referring to the drawings, FIG. 1 shows a first embodiment of a basic glass window 10 of the invention. Window 10 has a single continuous sheet of glass 12 having a front side and a back side. Glass sheet 12 can be made of tempered glass for increased safety and to virtually eliminate breakage. Mounted on at least one side of sheet 12 is a unitary pre-cast metal design component 14. As shown in FIG. 2, preferably two identical pre-cast design components 14 are mounted in front-to-back registration with one design component on each side of glass sheet 12 so that they give the appearance of being a single design component.

If desired, window 10 can be an insulated window comprising two sheets of glass separated by a spacer and held together by means of an adhesive sealant that is well known in the window making art, in which case the design components 14 are mounted in front-to-back registration on the opposed surfaces of one of the glass sheets.

Pre-cast design component 14 consists of a reticulated network of cames 16 and intersections 18. Intersections 18 are cast simultaneously with the cames 16, but they give the appearance of being soldered like the joints in a traditional leaded glass window. As shown in FIG. 2, the cames 16 have a convex exposed outer surface 20 and may be generally half-circular in cross-section, as shown, or generally rectangular in cross-section, or any other desired shape. The inner surface 22 of the cames may be flat, grooved, or slightly concave in cross-section as shown.

The cames 16 of unitary design component 14 are cold bonded directly to glass sheet 12 by a thin layer 24 of elastomeric adhesive. The concavity of the inner surface 22 of the cames and the thickness of the adhesive layer 24 has been somewhat exaggerated in FIG. 2 for purposes of illustration. The adhesive 24 extends into the slight concavity formed on the inner surface 22 of the cames 16 and forms a strong bond between the glass sheet 12 and the design component 14. The preferred adhesive for this purpose is an elastomeric silicone rubber adhesive which cures at room temperature. The elastomeric silicone rubber remains inherently flexible after fully curing and its flexible character compensates for the differences in the thermal rates of expansion and contraction between glass sheet 12 and design component 14.

A preferred metal for design component 14 is a tin-antimony-lead alloy and a most preferred metal is commercially available Linotype alloy having a composition of about 5% tin (Sn), 12% antimony (Sb), and 83% lead (Pb) by weight. Other metals such as aluminum and aluminum alloys can also be used, but Linotype alloy has the preferred combination of relatively high strength and low melting point. This lead alloy has a linear coefficient of thermal expansion of about $16\times10^{-6}$ whereas the linear coefficient of thermal expansion for a suitable soda-lime-silica glass is about $5\times10^{-6}$. Thus, it is necessary for adhesive layer 24 to be permanently flexible in order to compensate for the different linear coefficients of thermal expansion between the metal and the glass, otherwise repeated changes in temperature could soon cause adhesive layer 24 to separate from either glass sheet 12 or design component 14.

As shown in FIG. 1, there exists a distinct border of glass sheet 12 outside the dimensions of design component 14. The border allows window 10 to be installed in a conventional window frame using standard glazing techniques. The border also allows for trimming of glass sheet 12 (if it is not tempered glass) at the installation site to fit precisely in a particular window opening. A given untempered glass sheet 12 may be trimmed to desired size, then tempered, if specifications call for tempered glass.

To the ordinary observer, window 10 has an appearance which is quite attractive and quite similar to a traditional leaded glass window, but in fact window 10 is superior because it can be mass-produced at a lower cost, is weatherproof, and is much stronger. The single continuous sheet of glass 12 gives window 10 an impregnable, energy-efficient weatherproof seal. Thus, the disadvantages of traditional leaded glass windows, high cost and water leakage, have been eliminated in window 10.

Figure 4:
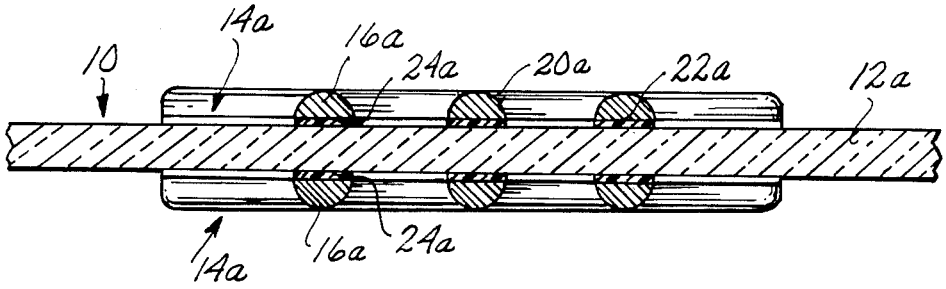
FIG. 4 is a cross-sectional view of a second embodiment of a basic glass window product of the present invention.

Window 10*a*, a second embodiment of the glass window of the invention, is shown in FIG. 4. Window 10*a* has a continuous sheet of glass 12*a* having a front side and a back side. Glass sheet 12*a* can be made of tempered glass for increased strength and safety. Mounted on at least one side of sheet 12*a* is a unitary pre-cast metal design component 14*a*. As shown in FIG. 4, two identical pre-cast design components 14*a* are preferably mounted in front-to-back registration with one design component on each side of glass sheet 12*a*.

Pre-cast design component 14*a* consists of a network of cames 16*a* that are connected at intersections as in the above-described first embodiment. As shown in FIG. 4, the reticulated cames 16*a* have a convex outer surface 20*a* which is substantially half-circular in cross-section and a flat inner surface 22*a*. The flat inner surface 22*a* can be either smooth or rough. A rough surface is preferred because it provides more surface area for the adhesive and thereby gives a stronger bond with the thin layer of elastomeric adhesive 24*a* which bonds the cames 16*a* to glass sheet 12*a*. The thickness of the adhesive layer 24*a* has been somewhat exaggerated in FIG. 4 for purposes of illustration.

The preferred embodiment of the decorative window product is the first embodiment window 10 shown in FIG. 2 wherein the cames 16 have an inner surface 22 which is slightly concave. Pull tests have been conducted to compare the bond strengths between the design components in the first embodiment window 10 and the second embodiment window 10*a*. The test results have shown that the design component 14 in the first embodiment has a higher bond strength. Nevertheless, it is to be recognized that the second embodiment window 10*a* is a commercially-acceptable product.

B. The Manufacturing Process

(a) The Casting Process

The first stage in the overall manufacturing process for the glass window product is the casting process to make the design component. The first step in the casting process is to make a master drawing on paper by conventional drafting techniques of a desired decorative design component, for example, the design component 14. The drawing is a 100.3% scale drawing of the pattern and the width of the cames. The 100.3% scale compensates for the shrinkage of the metal as it cools in the mold so that the casting will have precisely the desired final dimensions.

Figure 3:
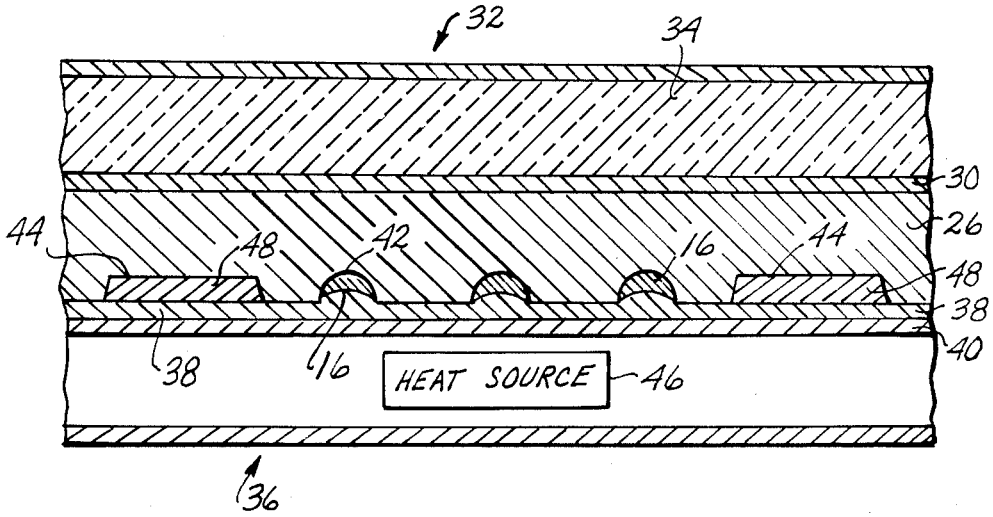
FIG. 3 is a cross-sectional schematic diagram of a mold held in a casting machine used for casting a first embodiment design component in the process of the present invention.

The second step is to fabricate a metal mold 26 (FIG. 3) for the design component 14 in conformity with the master drawing. The mold 26 can be made of any suitable metal, such as aluminum or steel. Steel is preferred. The mold is made by milling a suitable flat metal sheet to follow the cames and intersections of the master drawing. In addition to the cames and intersections, the mold 26 also includes a riser channel 44 and a series of feeder channels. The riser 48 is a member which is more or less rectangular in cross-section, but with downwardly sloping side walls and is several times wider than a came 16. A typical came 16 is about one-quarter inch wide and about one-eighth inch high. A typical riser 48 is about two inches wide and about one-eighth inch high. In the mold, the riser channel 44 is located about one inch outside the design component and has the form of a U surrounding the design component, thus the riser channel in the mold provides a path for the incoming molten metal to flow in and also a path for the air which has been displaced by the metal to flow out.

The feeders are connecting members which are similar to the cames in size and shape. In the mold, the feeder channels laterally connect the riser channel to the came channels, thus creating paths for the molten metal to flow from the riser channel into the came channels. There are usually about ten to twenty feeder channels spaced equally apart around the design component.

The third step is to attach the mold 26 (FIG. 3) to the flat bottom face 30 of the upper cabinet 32 of a casting machine. This is accomplished using double-sided adhesive tape or other suitable means. The upper cabinet has a layer of insulation 34 above the bottom face 30. The upper cabinet 32 and the lower cabinet 36 of the casting machine are in a horizontal position at this time. The mold 26 is now in an upside down position in the casting machine. The face of the mold is then dusted with powdered corn starch which acts as a mold release agent and as a flow-enhancing agent for the molten metal.

In order to make the slightly concave inner surface 22 in the cames 16, a metal sheet 38 of a suitable material is placed on top of the upper face 40 of the lower cabinet 36. A suitable material is an aluminum sheet about one-sixteenth of an inch in thickness. The sheet 38 is milled or formed so that it has an upward-curving slightly raised ridge pattern in its upper surface that follows the pattern of the came channels 42 in the mold 26. Furthermore, if desired, the raised pattern in the upper surface of layer 38 can be formed so that it has ribbing in it in order to form corresponding grooving in the inner surface 22 of cames 16.

The fourth step is to bring together under pressure the two cabinets 32 and 36, thereby sandwiching the mold 26 and the sheet 38 between the two cabinets. The slightly upward-curving pattern in the sheet 38 at the location of the came channels 42 causes the slightly concave inner surface 22 to be formed in the cast cames 16.

A double V-shaped spout is attached at one side of the mold to provide a channel to guide the molten metal into the riser channel 44 of the mold 26. The spout can be made of pieces of steel or other suitable material which are attached to the side of the mold to form a pathway for the molten metal. One V-portion connects to the incoming portion of the riser channel where the molten metal is poured in. The other V-portion connects to the outgoing portion of the riser channel where the air displaced by the metal exhausts.

The heat source 46 which heats the lower cabinet 36 of the casting machine is turned on in order to heat the mold 26 to the desired casting temperature, for example, about 460° to 475° F. if lead alloy is used. The proper mold temperature for casting will vary within this temperature range depending on the size of the design component being cast. A small component is usually cast at a temperature near the lower end of the temperature range while a large component is usually cast at a temperature near the higher end of the temperature range. The heat source 46 is preferably an electrical heating element.

The fifth step is to tilt the two cabinets 32 and 36 of the casting machine and the mold 26 to an angle of about 30° to 45° from the horizontal position so that the molten metal will flow down into the riser channel 44 of the mold 26 under the force of gravity.

The sixth step is to pour the molten metal into the spout and down into the mold 26 to fill the riser channel 44, the feeder channels (not shown) and the came channels 42. If lead alloy is used, the melting pot containing the molten metal is suitably maintained at a temperature of about 480° to 490° F.

The seventh step is to allow the mold 26 to cool. If lead alloy is used, the mold is cooled to about 450° to 455° F. The time for the cooling down step will vary depending on the size of the casting. A small design component will usually cool to the desired temperature in about five minutes whereas a large design component may require ten minutes. The operator then spreads apart the cabinets 32 and 36 of the casting machine after lowering them to the horizontal position. The cast design component 14 will usually fall out of the mold 26 under its own weight onto the lower cabinet 36 of the casting machine where it is removed and inspected for any quality defects by the operator. The riser 48 and the feeders (not shown) on the casting are then removed from the cames. They can usually be snapped off by hand. If the riser and the feeders don't snap off completely, then tin snips can be employed to finish this task. The point of attachment of each feeder can be filed or sanded to remove all roughness from the cames 16. The cast design component 14 is now ready for the next stage of the overall manufacturing process. The next stage can be a finishing process described below wherein the color of the design component is changed or the next stage can be the final assembly process, described below, if it is not desired to change the color of the design component.

The foregoing casting process steps can be repeated to mass produce design components 14. Various casting problems can occur in practicing the process, but the operator soon learns how to adjust the parameters of the process to solve any problem. For example, if the mold temperature is too high, the problem of porosity (tiny pores) may appear in the cames 16. If the mold temperature is too low, the problem of gaps (incomplete cames) may appear. Thus, the control of the mold temperature is a critical aspect in the practice of the process.

Figure 5:
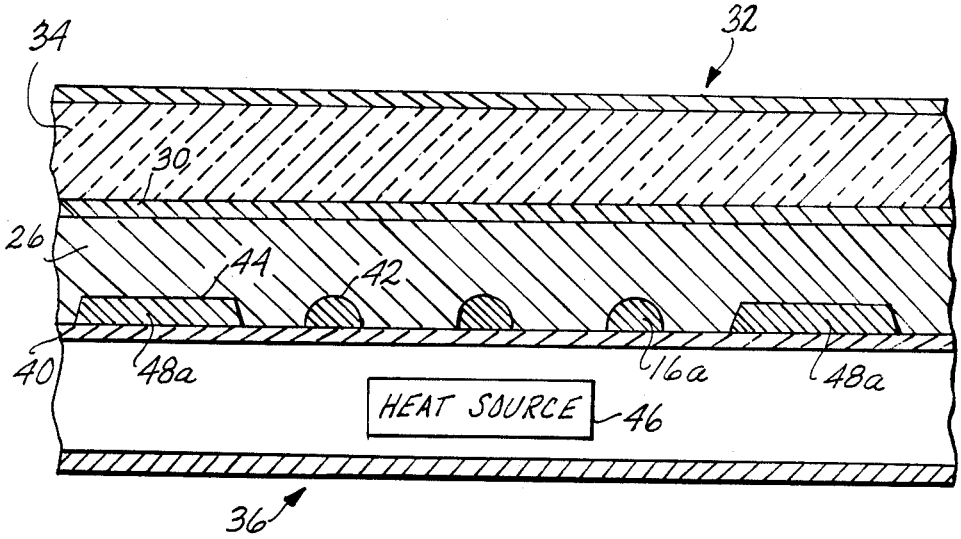
FIG. 5 is a cross-sectional schematic diagram of a mold held in a casting machine used for casting a second embodiment design component in the process of the present invention.

FIG. 5 illustrates a second form of the casting process used to produce the design component **14*a* of the second embodiment having cames 16*a* with a flat inner surface 22*a* shown in FIG. 4 and described above. In this second form of the casting process, the metal sheet 38 is eliminated so that the design component 14*a* is cast on the upper face 40 of the lower cabinet 36. In this form of the process, the upper face 40 is called the casting substrate. FIG. 5 shows the mold 26, the metal cames 16*a* filling the came channels 42 in the mold 26, and the metal riser 48*a* filling the riser channel 44 in the mold. Also shown are the bottom face 30 of the upper cabinet 32 of the casting machine, the casting substrate 40 which is the upper face of the lower cabinet 36 of the casting machine, and the heat source 46 inside the lower cabinet 36. The casting substrate 40 is a flat sheet, and if lead alloy is being used then casting substrate 40** is preferably made of aluminum or steel.

If it is desired to produce cames **16*a* having a flat inner surface 22*a* which is smooth, then the design component 14*a* is cast directly on the casting substrate 40. However, it is preferred to produce cames 16*a* having a flat inner surface 22*a* which is rough. To achieve this result, a thin coating of a polytetrafluoroethylene polymer, such as "Teflon", may be applied, as by spraying, to the upper surface of the casting substrate 40**, or this upper surface may be roughened in any other suitable manner as by acid etching.

(b) The Antique Finishing Process

The next stage in the overall manufacturing process is the finishing process to complete the cast design component 14 by imparting a different color or finish to the surface of the casting, if desired. For example, a raw lead alloy casting is typically a dull silver color and many users desire a different color for the design component. Two alternative finishing processes will be described in detail for a lead alloy casting. One finishing process is called the "antique finishing process" because it imparts a dark gray color to the cast design component 14.

The first step in producing the antique finish is to dip the raw lead alloy design component in a cleaning bath to remove any grease, cornstarch, etc. from the casting. The cleaning bath is water containing a soap solution maintained at 140° F. A specific product which has been found suitable for this purpose is a soap solution made by MacDermid, Inc. and sold under the trademark "Metex TS-40A". The casting is held in this bath for about two minutes. The casting is then removed and placed in a circulating cold water rinse bath for about one minute to rinse off the soap solution.

The second step is to place the casting in an electro-clean bath. The electro-clean bath is a strongly basic solution containing sodium hydroxide suitably at a pH level of about 13.2. An electrode is attached to the casting and an electric current passes through the casting while it is held in the bath. The bath is maintained at 145° F. and the casting is held in the bath for about 30 seconds to one minute. The casting is then removed and placed again in a circulating cold water rinse bath for about one minute to rinse off the caustic solution.

The third step is to place the casting in an activation acid bath to remove the oxide layer from the casting. This bath suitably contains a solution of 15% fluoboric acid (by weight) and is maintained at room temperature. The casting is held in the bath for about one and one-half minutes. The casting is then removed and placed in a circulating cold water rinse bath for about one minute.

The fourth step is to dip the design component casting in an antique finish bath suitably containing calcium polysulfide ($Ca_2S_x$) which darkens the lead alloy to the desired dark gray color. The casting is held in the bath for about 12 to 15 minutes and the bath is at room temperature. The cast design component is then removed and placed in a circulating cold water rinse bath for about one minute. The casting is then removed and placed in a hot water rinse bath at 135° F. for about 30 seconds. The design component is then removed and dried. The dry design component 14 is now ready for the next stage of the overall manufacturing process which will be described below after describing an alternative finishing process.

(c) The Brass Finishing Process

An alternative finishing process is called the "brass finishing process" because it deposits a brilliant brass coating on the cast design component. The first three steps in the brass finishing process are the same as the first three steps described above with respect to the antique finishing process and those three steps are incorporated here by reference.

The fourth step is to dip the cast design component 14 in a brass electroplating bath which deposits a coating of brass on the design component. The electroplating bath contains a brass plating composition made by MacDermid, Inc. and sold under the trademark "Bright Brass". An electrode is attached to the casting and an electric current passes through the casting while it is held in the bath. The bath is maintained at 110° F. and the casting is held in the bath for about 25 to 30 minutes. The casting is then removed and placed in a circulating cold water rinse bath for about two minutes and then it is removed and placed in a hot water rinse bath at 135° F. for about one minute. This rinse sequence is repeated twice.

The fifth step is to dip the casting in a chromate bath which seals the brass coating. The chromate bath suitably contains a chromate composition made by MacDermid, Inc. and sold under the trademark "Macro Brass 1". The bath is maintained at room temperature and the casting is held in the bath for about 5 minutes. The cast design component is then removed and placed in a circulating cold water rinse bath for about one to two minutes and then it is removed and placed in a hot water rinse bath at 135° F. for about 30 seconds. The design component is then removed and dried. The dry design component 14 is now ready for the next stage of the overall manufacturing process.

(d) The Assembly Process

The final stage in the overall manufacturing process is the assembly process wherein the design component 14 is bonded to the glass sheet 12. The design component is bonded directly to the glass sheet by a thin layer of elastomeric adhesive 24. The preferred adhesive is a silicone rubber adhesive which cures at room temperature. A specific product which has been found suitable is a translucent uncolored silicone rubber adhesive made by the General Electric Company and identified as its product no. RTV 108 TRANS. A thin layer of the elastomeric adhesive is applied to the inner surface 22 of the cames 16 at room temperature. The design component 14 is then placed on the glass sheet 12 and the adhesive is allowed to cure at room temperature for about 12 to 24 hours. It is preferred to place a padded weight on top of the design component to maintain pressure contact between the design component and the glass sheet while the adhesive is curing.

After the design component 14 has been adhesively bonded to one side of the glass sheet 12, a second design component, if desired, may be bonded to the other side of the sheet. The glass sheet 12 is turned over and a second identical design component 14 is adhesively bonded in the same way to the other side of the glass sheet in front-to-back registration with the first design component as shown in FIG. 2. After the second adhesive layer has fully cured, any excess adhesive is cleaned off the glass sheet and the manufacturing process is completed. It should be understood that the second design component is optional and may not be required in certain applications where observers can not see the back side of the window in use.

Figure 6:
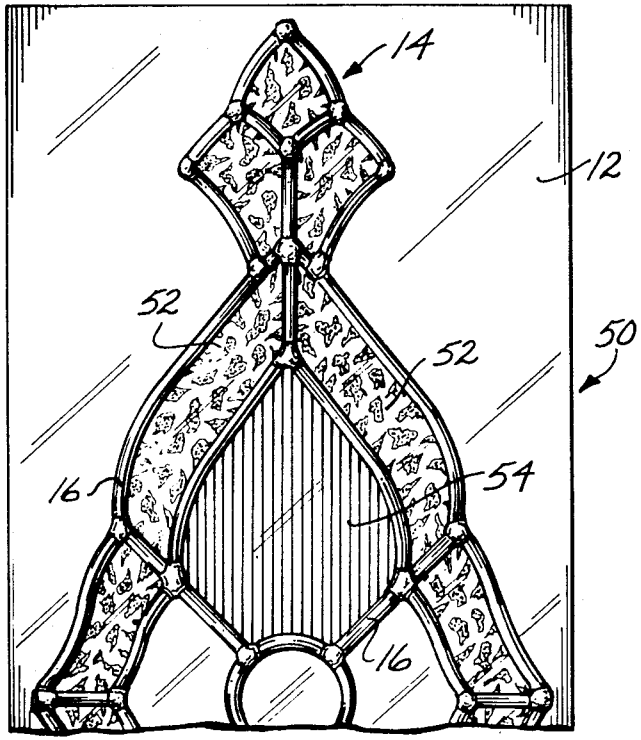
FIG. 6 is a fragmentary side elevational view of a modified glass window product of the present invention showing certain special effects which have been added to selected areas of a basic glass window product.

FIG. 6 shows a modified version 50 of the basic glass window product 10. FIG. 6 illustrates that selected zones 52 can be given a conventional "glue chipping" treatment and that a selected zone 54 can be conventionally colored by fritting or by staining to produce any desired color, for example the color red as shown by the lining in zone 54. The glue chipping of zones 52 and the fritting or staining of zone 54 are performed on glass sheet 12 before the design component 14 is adhesively bonded to the glass sheet. If desired, some of the zones of the glass can also have a sand-blasted surface area.

Figure 7:
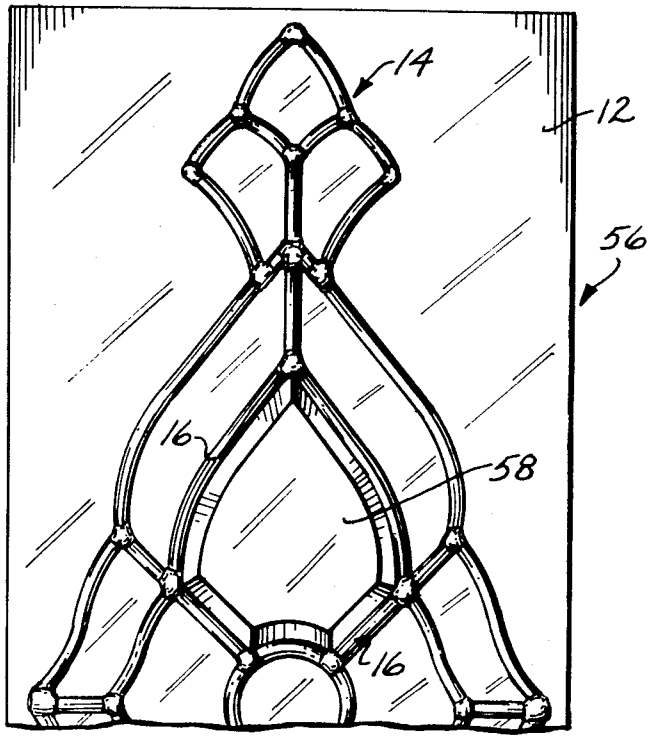
FIG. 7 is a fragmentary side elevational view of another modified glass window product of the present invention showing a bevelled glass insert which has been added to a selected area of a basic glass window product.

FIG. 7 shows another modified version 56 of the basic glass window product 10. FIG. 7 illustrates that a bevelled glass insert 58 can be adhesively bonded to a selected zone within design component 14. Glass insert 58 is suitably set in place after the design component 14 has been adhesively bonded to glass sheet 12.

As will be apparent to those skilled in the art to which the invention is addressed, the present invention may be embodied in forms other than those specifically disclosed above without departing from the spirit or essential characteristics of the invention. The particular embodiments of the glass window product and the manufacturing process, as described above, are therefore to be considered in all respects illustrative and not restrictive, with the scope of the present invention being set forth in the appended claims rather than being limited to the foregoing description.

What is claimed is:

1. A decorative glass window product comprising:

(a) a sheet of glass;

(b) a metal design component consisting essentially of, an integrally pre-cast, reticulated came network fabricated into a single piece of metal;

(c) said metal design component being bonded on its inner surface to one side of said sheet of glass; and (d) a thin layer of an elastomeric adhesive bonding said metal design component to said sheet of glass.

2. The glass window product of claim 1 wherein said came network lies wholly within the edges of the sheet of glass and is spaced from said edges.

3. The glass window product of claim 1 wherein said sheet of glass is tempered glass.

4. The glass window product of claim 1 wherein said metal design component is slightly concave on its inner surface.

5. The glass window product of claim 1 wherein said metal design component is rough on its inner surface.

6. The glass window product of claim 1 wherein said metal design component is flat on its inner surface.

7. The glass window product of claim 6 wherein said flat inner surface is rough.

8. The glass window product of claim 1 wherein said metal design component is cast of a tin-antimony-lead alloy.

9. The glass window product of claim 7 wherein said metal design component is cast of Linotype alloy having a composition of about 5% tin, 12% antimony, and 83% lead by weight.

10. The glass window product of claim 1 wherein two identical pre-cast metal design components are bonded in front-to-back registration with one on each side of said sheet of glass.

11. The glass window product of claim 1 wherein said elastomeric adhesive is a silicone rubber adhesive which cures at room temperature.

* * * * *